US006873267B1

(12) United States Patent
Tubel et al.

(10) Patent No.: US 6,873,267 B1
(45) Date of Patent: Mar. 29, 2005

(54) METHODS AND APPARATUS FOR MONITORING AND CONTROLLING OIL AND GAS PRODUCTION WELLS FROM A REMOTE LOCATION

(75) Inventors: Paul Tubel, The Woodlands, TX (US); Mark Crawford, Houston, TX (US); Henning Hansen, Randaberg (NO); Rolv Arne Flaaten, Bryne (NO)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/408,045

(22) Filed: Sep. 29, 1999

(51) Int. Cl.[7] ..... G01V 3/00

(52) U.S. Cl. ..... 340/853.3; 340/853.1; 166/250.15; 73/152.18

(58) Field of Search ..... 340/854.3, 853.1, 340/853.3; 166/250.01, 250.15, 252; 73/152.18

(56) References Cited

U.S. PATENT DOCUMENTS

| | | | |
|---|---|---|---|
| 3,739,845 A | 6/1973 | Berry et al. | 166/65 R |
| 3,951,338 A | 4/1976 | Genna | 236/93 A |

(Continued)

FOREIGN PATENT DOCUMENTS

| | | | |
|---|---|---|---|
| GB | 2 317 406 A | 3/1998 | E21B/43/12 |
| WO | WO 00/45031 | 8/2000 | |

OTHER PUBLICATIONS

Microsoft Press, Computer dictionary. 1997, pp. 430, 258, and 276.*

PCT International Search Report for International Application PCT/US00/02420 mailed May 11, 2000.

International Search Report, dated Dec. 13, 2000 (PCT/GB00/03662).

* cited by examiner

*Primary Examiner*—Albert K. Wong
(74) *Attorney, Agent, or Firm*—Moser, Patterson & Sheridan, L.L.P.

(57) ABSTRACT

The invention provides apparatus and methods for monitoring and controlling hydrocarbon production wells and/or injection wells from a remote location. The apparatus for monitoring and controlling one or more hydrocarbon production wells or injection wells from a remote location comprises one or more surface control and data acquisition systems; one or more sensors disposed in communication with the one or more control and data acquisition systems; one or more downhole flow control devices disposed in communication with the one or more control and data acquisition systems; and one or more remote controllers disposed in communication with the one or more control and data acquisition systems. Preferably, the remote controller comprises a computer having an internet access disposed in communication with the one or more control and data acquisition systems through a communication device comprising an internet web site server. The method for monitoring and controlling a downhole hydrocarbon production well or an injection well comprises: transmitting data collected by a downhole sensor module to a control and data acquisition system; evaluating downhole operating conditions and optimizing downhole operating parameters utilizing an optimization software program disposed in communication with the control and data acquisition system; and transmitting signals between the control and data acquisition system system and a remote controller utilizing a satellite communication system, the remote controller comprising a computer and an internet browser control access adapted to display operating conditions and parameters and to accept instructions to change operating parameters.

37 Claims, 9 Drawing Sheets

U.S. PATENT DOCUMENTS 4,676,313 A 6/1987 Rinaldi ..... 166/252
4,936,386 A 6/1990 Colangelo ..... 166/292
5,273,112 A 12/1993 Schultz ..... 166/374
5,481,502 A * 1/1996 Cretin et al. ..... 367/77
5,597,042 A 1/1997 Tubel et al. ..... 166/250.01
5,609,204 A 3/1997 Rebardi et al. ..... 166/51
5,662,165 A * 9/1997 Tubel et al. ..... 166/250.01
5,706,892 A 1/1998 Aeschbacher, Jr. et al. ... 166/66
5,706,896 A 1/1998 Tubel et al. ..... 166/313
5,730,219 A 3/1998 Tubel et al. ..... 166/250.01
5,732,776 A 3/1998 Tubel et al. ..... 166/250.15
5,752,570 A 5/1998 Shaposhnikov et al. .... 166/372
5,823,263 A 10/1998 Morris et al. ..... 166/313
5,883,583 A 3/1999 Kishino ..... 340/853.3
5,955,666 A 9/1999 Mullins ..... 73/152.18
5,992,519 A * 11/1999 Ramakrishnan et al. ..... 166/250.01
6,089,832 A * 7/2000 Patterson ..... 166/68.5
6,209,642 B1 * 4/2001 Streetman ..... 166/267
6,356,205 B1 * 3/2002 Salvo et al. ..... 340/853.3
6,426,917 B1 * 7/2002 Tabanou et al. ..... 367/82

METHODS AND APPARATUS FOR MONITORING AND CONTROLLING OIL AND GAS PRODUCTION WELLS FROM A REMOTE LOCATION

BACKGROUND OF THE INVENTION

1. Field of the Invention

The present invention relates generally to methods and apparatus for the control of production wells and injection wells. More particularly, the invention relates to methods and apparatus for monitoring and controlling oil and gas production wells or zones in a well and injection wells from a remote location or on site by a completely self contained intelligent system.

2. Background of the Related Art

The control of oil and gas production from wells constitutes an on-going concern of the petroleum industry due, in part, to the enormous monetary expense involved, as well as the risks associated with environmental and safety issues. Production well control has become particularly important and more complex in view of the industry wide recognition that wells having multiple branches (i.e., multilateral wells) will be increasingly important and commonplace. Such multilateral wells include discrete production zones which produce fluid in either common or discrete production tubing. In either case, there is a need for controlling zone production, isolating specific zones and monitoring each zone in a particular well.

Lift Systems

One type of production system utilizes electrical submersible pumps (ESP) for pumping fluids from downhole. Such pumps may comprise impeller driven pumps or submersible progressing cavity pumps (SPCP's). Also, pumps powered by pressurized hydraulic fluid driven impellers or the like can be used. In addition, there are other types of production systems for oil and gas wells, such as plunger or rod driven progressing cavity pumps (PCP's), plunger lift and gas lift. Plunger lift production systems include the use of a small cylindrical plunger which travels through tubing extending from a location adjacent the producing formation down in the borehole to surface equipment located at the open end of the borehole. In general, produced fluids which collect in the borehole and inhibit the flow of fluids out of the formation and into the wellbore, are collected in the casing/tubing. Periodically, the tubing is opened and the accumulated reservoir pressure is sufficient to force the plunger up the tubing. The plunger carries with it to the surface a load of accumulated fluids which are ejected out the top of the well thereby allowing hydrocarbon or gas to flow more freely from the formation into the wellbore and be delivered to a distribution system at the surface. After the flow of gas has again become restricted due to the further accumulation of fluids downhole, a valve in the plunger or the tubing at the surface of the well is closed so that the plunger then falls back down the tubing and is ready to lift another load of fluids to the surface upon the reopening of the valve.

Rod driven pumps are in quite common usage in relatively shallow producing wells. A surface source of motive power repetitively lifts and lowers a pump plunger or turns a shaft in the PCP inside a production tubing string via a rod string which extends from the surface. Each plunger stroke or rod revolution in the PCP lifts a quantity of produced fluid to the surface distribution system. The volume of fluid produced by each stroke of the rod driven plunger or shaft revolution of the PCP is a function of the permeability of the producing formation and the formation pressure causing flow into the casing/tubing annulus through the production perforations in the casing, or in a gravel pack completion, through a screen or liner. It will be appreciated by those of skill in the art that some type of control of the opening or closing of the perforations or the screen or liner to fluid flow could, in an intelligent completion system such as that of the present invention, could be used to control undesired water entry such as that caused by "water coning." Such control can also be provided, for example, by the use of a sliding sleeve device such as that described subsequently herein to mask or unmask a screen, liner, or perforations by its motion.

A gas lift production system includes a valve system for controlling the injection of pressurized gas from a gas source, such as another gas well, a gas zone in the same well, or a compressor, into the borehole. The pressure from the injected gas, when permitted to enter the tubing via one or more gas lift valves allows accumulated formation fluids to flow up a production tubing extending along the borehole to remove the fluids and restore the free flow of gas and/or oil from the formation into the well. In wells where liquid fall back is a problem during gas lift, plunger lift may be combined with gas lift to improve efficiency. All of the foregoing types of lift systems can be referred to as artificial lift systems. In some wells, of course, with adequate producing formation pressure, no artificial lift system is required.

In both plunger lift and gas lift production systems, there is a requirement for the periodic operation of a motor valve at the surface of the wellhead to control either the flow of fluids from the well or the flow of injection gas into the well to assist in the production of gas and liquids from the well. These motor valves have been conventionally controlled by timing mechanisms and are programmed in accordance with principles of reservoir engineering which determine the length of time that a well should be either "shut in" and restricted from the flowing of gas or liquids to the surface and the time the well should be "opened" to freely produce. Generally, the criteria used for operation of the motor valve is strictly one of the elapse of a preselected time period. In most cases, measured well parameters, such as pressure, temperature, etc., are used only to override the timing cycle in special conditions.

It will be appreciated that relatively simple, timed intermittent operation of motor valves and the like is often not adequate to control either outflow from the well or gas injection to the well so as to optimize well production. As a consequence, sophisticated computerized controllers have been positioned at the surface of production wells for control of downhole devices such as the motor valves or the gas lift valves.

In addition, such computerized controllers can be used to control other downhole devices such as hydro-mechanical safety valves or sliding sleeve valves. Microprocessor-based controllers are also used for zone production control within a well and, for example, can be used to actuate sliding sleeves and inflatable or expandable packers by the transmission of a surface command to downhole microprocessor controllers and/or electromechanical control devices.

Sensor Systems

The surface controllers may also be connected to downhole sensors which transmit information to the controller such as pressure, temperature and flow rate. This data is then processed at the surface by the computerized control system.

Electrically submersible pumps (ESP's) or SPCP's can use pressure and temperature readings received at the surface from downhole sensors to change the speed of the pump in the borehole. As an alternative to downhole sensors, wire line production logging tools are also used to provide downhole data on pressure, temperature, flow, gamma ray and pulse neutron, or other formation characteristics using a wire line surface unit.

Prior Control Systems

There are numerous patents related to the control of oil and gas production wells. In general, these patents relate to surface control systems using a surface microprocessor or downhole control systems that are initiated by surface generated control signals. The surface control system patents generally disclose computerized systems for monitoring and controlling a gas/oil production well whereby the control electronics is located at the surface and communicates with sensors and electromechanical devices near the surface. A example of a surface control system is described in U.S. Pat. No. 4,633,954, Dixon et al., which is hereby incorporated by reference in its entirety. The downhole control system patents generally disclose downhole microprocessor controllers, electromechanical control devices and sensors. An example of a downhole control systems is described in U.S. Pat. No. 5,273,112, Schultz, which is hereby incorporated by reference in its entirety.

In another method of controlling the production well, the surface system is connected to a variable frequency drive system that varies the speed of the artificial lift system based on the pressure and flow information downhole and transferred to the surface controller. A more advanced control system links the surface control via radio communication or cellular phone to a remote controller, and the data received from the downhole monitoring system is transferred from the surface controller to the processor at the remote location on a regular basis. Changes to the well operating parameters may then be sent from the remote controller to the surface controller via radio communication or cellular phone on a regular basis. However, such systems do not provide flexibility in the location of access of the human operators because the physical locations of the surface controllers and the remote controller dictate the location from which the production parameters can be controlled and changed. Furthermore, such prior art systems do not provide flexibility in the choice of their mode of operation as to controlling one zone, one well, or an entire hydrocarbon production from a field.

While it is well recognized that hydrocarbon production wells will have increased production efficiencies and lower operating costs if surface computer based controllers and downhole microprocessor controllers (actuated by external or surface signals) of the type discussed hereinabove are used, the presently implemented control systems nevertheless suffer from other drawbacks and disadvantages.

One significant drawback of present production well control systems involves the extremely high cost associated with implementing changes in well control and related workover operations. Presently, if a problem is detected at the well, the customer is required to send a drawworks or rig to the wellsite at an extremely high cost (e.g., five million dollars for 30 days of offshore work). The well must then also be shut in during the workover causing a large loss in revenues (e.g. 1.5 million dollars for a 30 day period). Associated with these high costs are the relatively high risks of adverse environmental impact due to spills and other accidents as well as potential liability of personnel at the rig site. Of course, these risks can lead to even further costs. Because of the high costs and risks involved, in general, a well operator may delay important and necessary workover of a single well until other wells in that area encounter problems. This delay may cause the production of the well to decrease or be shut in until the rig is brought in. The system of the present invention offers retrievable pumps, controllers, and/or sensor modules without the need for a full derrick, drawworks and a casing or tubing pulling operation.

Therefore, there is a need for a system for monitoring and controlling production wells that provides substantially "real time" data to an operator and which allows an operator to control the production operation from a remote location and which offers greater flexibility and retrievable system components.

SUMMARY OF THE INVENTION

The invention provides apparatus and methods for monitoring and controlling hydrocarbon production wells and/or injection wells from a remote location. The apparatus for monitoring and controlling one or more hydrocarbon production wells or injection wells from a remote location comprises one or more surface control and data acquisition systems; one or more sensors disposed in communication with the one or more control and data acquisition systems; one or more downhole flow control devices disposed in communication with the one or more control and data acquisition systems; and one or more remote controllers disposed in communication with the one or more control and data acquisition systems. Preferably, the remote controller comprises a computer having an internet access disposed in communication with the one or more control and data acquisition systems through a communication device comprising an internet web site server.

The method for monitoring and controlling a downhole hydrocarbon production well or an injection well comprises: transmitting data collected by a downhole sensor module to a surface control and data acquisition system; evaluating downhole operating conditions and optimizing downhole operating parameters utilizing an optimization software program disposed in communication with the surface control and data acquisition system; and transmitting signals between the surface control and data acquisition system and a remote controller utilizing a satellite communication system, the remote controller comprising a computer and an internet browser control access adapted to display operating conditions and parameters and to accept instructions to change operating parameters.

Another aspect of the invention provides a completely closed loop operating system utilizing a reservoir modeling program for a complete oilfield can be incorporated into the remote controller computer, or at the surface monitoring and control computer. Complete flexibility in zone, reservoir or entire field operation may be achieved by supplying zone, well, or entire field downhole pressure, temperature, flow rate, seismic input, electric, sonic or nuclear logging data, and any other downhole production parameters which sensors can measure to a system operated mathematical model of the zone, well, or field which is capable of optimizing the timing of flow or shut in of zone, well, or multiple wells in a field, to achieve maximum cost effectiveness and production output from the zone, well or field which it is designed to monitor and control.

Moreover, the methods and apparatus of the present invention incorporate the flexibility of operation which allows replacement of worn or inoperative downhole components without the necessity of bringing a full blown drawworks or rig onto a given well site. The novel systems and methods of the present invention offer multiple methods and apparatus for retrieving and/or replacing downhole components such as valves, sensors, artificial lift components, and sealing members such as packers by the use of mere portable masts for wireline or coil tubing reels, rather than complete removal of production tubing from a given well. These methods and apparatus, additionally, are selective in nature, not sequential, ie., a component mid way down a well, near the surface, or at the bottom may be equally accessed without removal of production tubing from the well.

BRIEF DESCRIPTION OF THE DRAWINGS

So that the manner in which the above recited features and advantages of the present invention are attained can be understood in more detail, a more particular description of the invention, briefly summarized above, may be had by reference to the aspects of the invention and the embodiments thereof which are illustrated in the appended drawings.

It is to be noted, however, that the appended drawings illustrate only typical embodiments according to the broader concepts of this invention and are therefore not to be considered limiting of its scope, for the invention may admit to other equally effective embodiments.

DETAILED DESCRIPTION OF THE INVENTION

The present invention generally provides a system for controlling hydrocarbon production wells or injection wells from a remote location. More particularly, the present invention provides apparatus and methods for controlling from a remote location the process of artificial lifting hydrocarbons to the surface utilizing one or more wells at a single platform and/or multiple wells located at multiple platforms or locations. The control and monitor system of the present invention is adaptable for controlling individual zones in multiple wells on multiple platforms, all from a remote location.

The control and/or monitoring system of this invention generally comprises a downhole control/monitor module, a surface control and data acquisition system disposed in communication by satellite, for example, with the downhole control/monitor module, and a remote control system disposed in communication by satellite, for example, with the surface control and data acquisition system.

Figure 1:
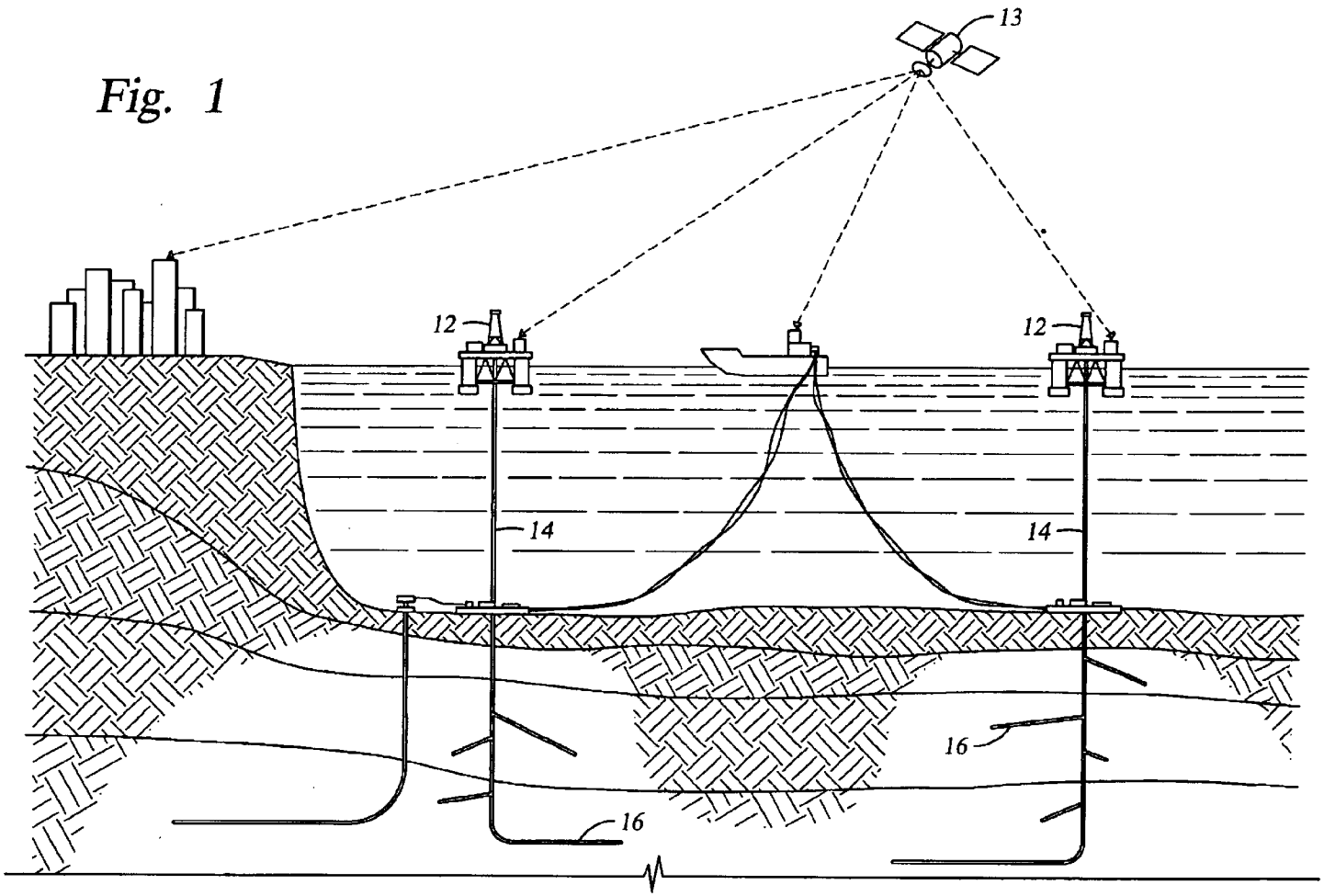
FIG. 1 is a schematic view of the remote control system of the present invention for use in controlling a plurality of offshore well platforms having a plurality of wells and zones.

FIG. 1 is a schematic view of the remote control system of the present invention for use in controlling a plurality of offshore well platforms having a plurality of wells and zones. The remote control system communicates with a plurality of well platforms via earth satellite 13 transmission. Each well platform is typically associated with a plurality of wells that extend from each platform through water to the surface of the ocean floor and then downwardly into formations under the ocean floor. Although the invention is illustrated in relation to offshore platforms, the inventors contemplate that the invention could also because to control land based wells and oilfields as well.

Each platform 12 is associated with a plurality of wells 14, and a given well 14 is divided into a plurality of separate production zones 16 which are required to isolate specific areas of a well for purposes of producing selected fluids, preventing blowouts and avoiding water intake. Such zones may be positioned in a single vertical well or such zones can result when multiple wells are completed in a common production zone. The oilfield depicted includes contemporary features of well production such as the drilling and completion of lateral or branch wells that extend from a particular primary wellbore. These lateral or branch wells can be completed such that each lateral well constitutes a separable production zone and can be isolated for selected production. As shown in FIG. 1, each well can include a plurality of zones that need to be monitored and controlled for efficient production and management of the well fluids, and each production zone includes a completion for production of hydrocarbons.

Figure 2:
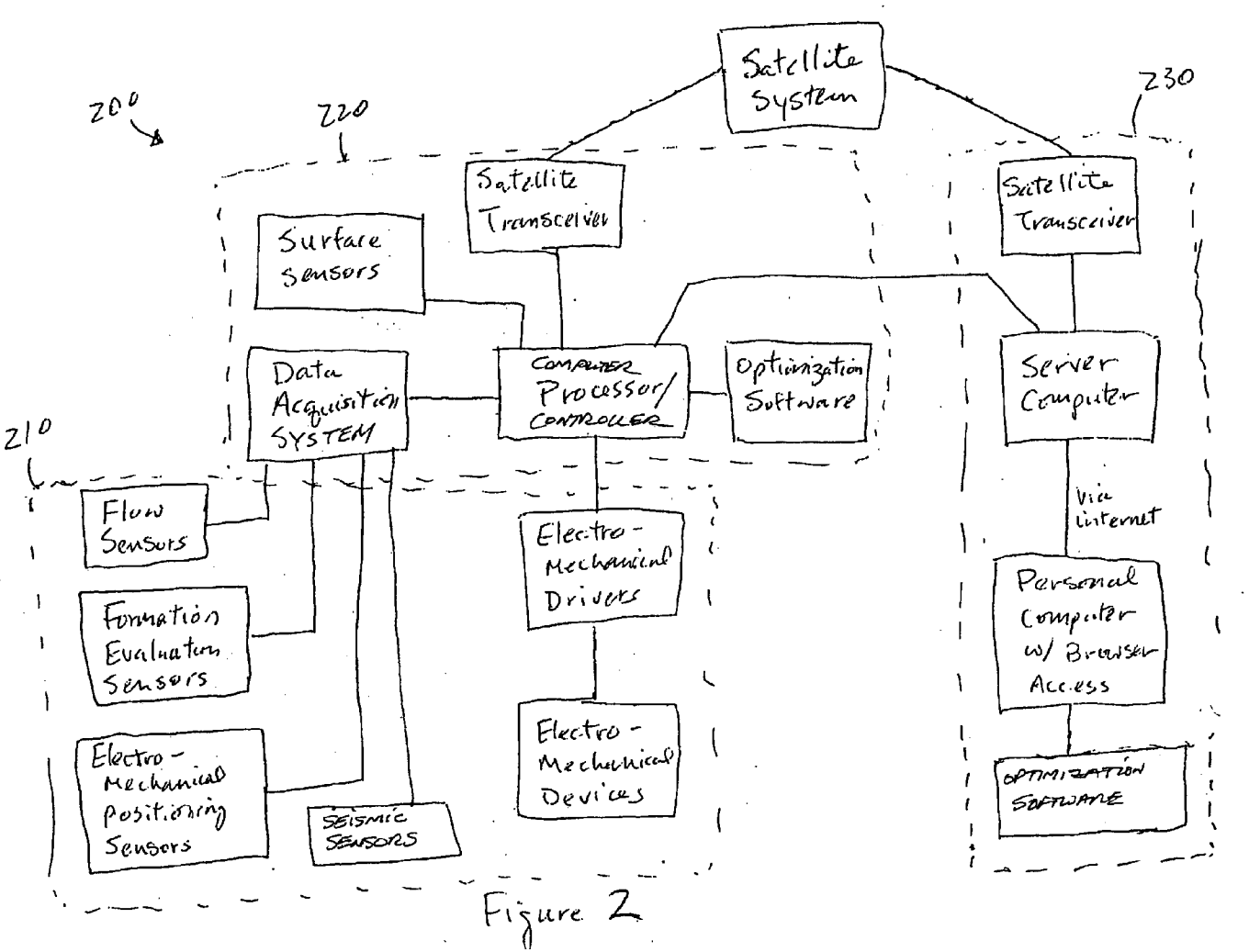
FIG. 2 is a block diagram illustrating the remote monitoring and control system of the present invention.

FIG. 2 is a block diagram illustrating the remote monitoring and control system of the present invention. The remote monitoring and control system 200 comprises a downhole sensor/control module 210 disposed downhole, a surface control and data acquisition system 220 disposed in communication with the downhole sensor/control module 210, and a remote control system 230 disposed in communication with the surface control and data acquisition system 220 via a satellite transceiver component and an antenna. Optionally radio links, fiber optic cable or other high data rate communication links could be used if desired.

The downhole sensor/control module 210 preferably comprises a plurality of downhole sensors, downhole control electronics, seismic sensors and downhole electromechanical modules that can be placed in different zones in a well. Preferably, each zone of each well includes a downhole control/monitor module dedicated to monitor and control production and operating parameters for that particular zone.

The downhole sensor/control module 210 is preferably hardwired to communicate with the surface control and data acquisition system via electrical cable carried by the production tubing. Other suitable communications techniques include wireless transmissions such as low frequency radio transmission from the surface location or from a subsurface location, with corresponding radio transmission feedback from the downhole components to the surface location or subsurface location; the use of acoustic transmission and reception; the use of electromagnetic wave transmission and reception; the use of microwave transmission and reception; the use of fiber optic communications through a fiber optic cable carried by the production tubing from the surface to the downhole components; and the use of electrical signaling from a wire line carried transmitter to the downhole components with subsequent feedback from the downhole components to the wire line carried transmitter/receiver, and the use of fluid lines to provide signals. Communication may also consist of various modulation types such as frequencies, amplitudes, codes or variations or combinations of these parameters or a transformer or inductive coupled technique which involves wire line conveyance of a transformer primary or secondary coil to a downhole tool. Either the primary or secondary of the transformer is conveyed on a wire line with the other half of the transformer residing within the downhole tool. When the two portions of the transformer are mated, data and electrical power can be interchanged.

The surface control and data acquisition system preferably interfaces with all of the zones/wells of a well-plattorm or location and the downhole component devices to poll each sensor device for data related to the status of the downhole sensors attached to the module. In general, the surface control and data acquisition system allows the operator to control the position, seal statue, and/or fluid flow in each zone of the well by sending a command to the device being controlled in the wellbore. An important function of the surface control system is to monitor, control and optimize the fluid or gas flow from the formation into the wellbore and from the wellbore into the surface.

In order to optimize the production of hydrocarbonaceous fluids from each zone, well, or the entire oilfield both the surface control and data acquisition system and/or the remote control system 230 are provided with computer components which have access via one or more server computers to the world wide web, or internet, via their respective satellite transceivers and communications systems, or the like. This internet access allows the input of formation geological data, data gathered during the drilling operation prior to completion of a well, area seismic data such as 3D seismic, economic data such as hydrocarbon product prices, mapping and topological data for the geographical area of the field, climate data, operating parameter data on downhole system components, etc., to an optimization software package which can be provided to both surface control and data acquisition system 220 and remote control system 230. The optimization software packages can comprise zone, well, or entire field flow prediction and control software packages such as the Vertex 1000 software available from Vertex Petroleum Systems of Englewood, Colo., or the CS Lift product family system available from Case Services Inc., of Houston, Tex. These types of optimization software packages can include mathematical models of a single zone, multiple zones, a complete well, or even an entire oilfield. Changes in downhole flow parameters in a zone, well, or for an entire field can be modeled as a function of time and their effects on ultimate hydrocarbon production amount and rate for the zone, well or field can be used to provide command signals from/to the surface control and data acquisition system 220 and/or remote control system 230 to the downhole components in the zone, well, or oilfield to optimize hydrocarbon production to any desired set of parameters.

The surface control and data acquisition system also includes an optimization software programmed to automatically monitor and control the activities in the wellbore by monitoring data collected by the well sensors connected to the data acquisition electronics and responding to changes in the well/zone field conditions by changing the downhole mechanics according to the programmed response optimized for a particular set of operating conditions. The surface control and data acquisition system includes a computer that provides commands to downhole tools such as a packer, sliding sleeve or valve to open, close, change state or do whatever other action is required if certain sensed parameters are outside the normal or pre-selected well zone operating range. An operator can override the operating parameters by entering an external or surface command from the surface control and data acquisition system or from the remote controller.

The surface control and data acquisition system includes a computer system used for processing, storing and displaying the information acquired downhole and interfacing with the operator. The computer system preferably comprises a personal computer or a work station with a processor board, short term and long term storage media, video and sound capabilities as is well known. The computer control is powered by a power source for providing energy necessary to operate the surface control and data acquisition system as well as any component of the downhole control/monitor module. Power is regulated and converted to the appropriate values required.

The surface control and data acquisition system preferably also includes a printer/plotter which is used to create a paper record of the events occurring in the well. The hard copy generated by computer can be used to compare the status of different wells, compare previous events to events occurring in existing wells and to get formation evaluation logs. The data acquisition system preferably comprises analog and digital inputs and outputs, computer bus interfaces, high voltage interfaces and signal processing electronics as well known in the art.

The surface control and data acquisition system interfaces with the downhole sensor modules to acquire data from the wellbore and controls the status of the downhole devices and the fluid flow from the well or from the formation. A depth measurement system preferably interfaces with the surface control and data acquisition system and provides information related to the location of the tools in the borehole as the production tubing carried tool string is lowered into the borehole. The surface control and data acquisition system also includes one or more surface sensors 46 which are installed at the surface for monitoring well parameters such as pressure, rig pumps and heave, all of which can be connected to the surface system to provide the operator with additional information on the status of the well.

The surface control and data acquisition system preferably controls the activities of the downhole control modules by requesting sensor measurement data on a periodic basis and commanding the downhole modules to open, or close electromechanical devices such as seals or valves and to change monitoring parameters due to changes in long term borehole conditions. When an operation parameter needs to be changed, the surface control and data acquisition system sends a control signal to a downhole electromechanical control device which then actuates a downhole component such as a sliding sleeve, packer seal or other type flow or pressure control valve. The present invention can automatically control downhole component in response to sensed selected downhole parameters. Alternatively, the downhole control modules also receives downhole sensor information directly and are programmed to control the downhole devices directly in response to the received information. For this alternative, the surface control and data acquisition system can provide an override command in this case to change the downhole control module's programmed responses.

The surface control and data acquisition system also acquires and processes data sent from surface sensors and downhole sensors as received from the data acquisition system. The data acquisition system preferably preprocesses the analog and digital sensor data by sampling the data periodically and formatting it for transfer to the electronic computer or processor of the surface control and data acquisition system. Included among this data is data from flow sensors, formation evaluation sensors, seismic sensors and electromechanical position sensors that provide information on position, orientation and the like of the downhole components. The formation evaluation data is processed for the determination of reservoir parameters related to the well production zone being monitored by the downhole control module. The flow sensor data is processed and evaluated against parameters stored in the downhole module's memory to determine if a condition exists which requires the intervention of the processor electronics to automatically control the electromechanical devices. The seismic or acoustic data gathered from downhole passive detectors is also processed in the surface control and data acquisition system to determine, for example, sand or debris impingement into the casing/tubing annulus. The automatic control executed by this processor can be initiated without the need for an initiation or control signal from the surface or from some other external source. Thus the surface control and data acquisition system can, if desired, provide a closed loop system for well, zone or field optimization.

The downhole sensors associated with flow sensors and formation evaluations sensors may include, but are not limited to, sensors for sensing pressure, flow, temperature, oil/water content, geological formation parameters such as porosity or density, gamma ray detectors and formation evaluation sensors which utilize acoustic, nuclear, resistivity and electromagnetic technology. It will be appreciated that typically, the pressure, flow, temperature and fluid/gas content sensors will be used for monitoring the production of hydrocarbons while the formation evaluation sensors will measure, among other things, the movement of hydrocarbons and water in the formation. The surface control and data acquisition system preferably automatically execute commands for actuating electromechanical drivers or other electronic control apparatus. In turn, the electromechanical driver will actuate an electromechanical device for controlling a downhole tool such as a sliding sleeve, shut off device, valve, variable choke, smart shunt screen, smart screen chokes, penetrator valve, perforator valve or gas lift tools. The surface control and data acquisition system may also control other electronic control apparatus such as apparatus that may effect flow characteristics of the fluids in the well. In addition, the surface control and data acquisition system is capable of recording downhole data acquired by flow sensors, formation evaluation sensors and electromechanical position sensors.

The downhole sensor system includes a power source for operation of the system. Power source can be generated in the borehole, at the surface or it can be supplied by energy storage devices such as batteries. Power is used to provide electrical voltage and current to the electronics and electromechanical devices connected to a particular sensor in the borehole. Power for the power source may come from the surface through hardwiring or may be provided in the borehole such as by using a turbine generator. Other power sources include chemical reactions, flow control, thermal, conventional batteries, borehole electrical potential differential, solids production or hydraulic power methods.

Figure 3:
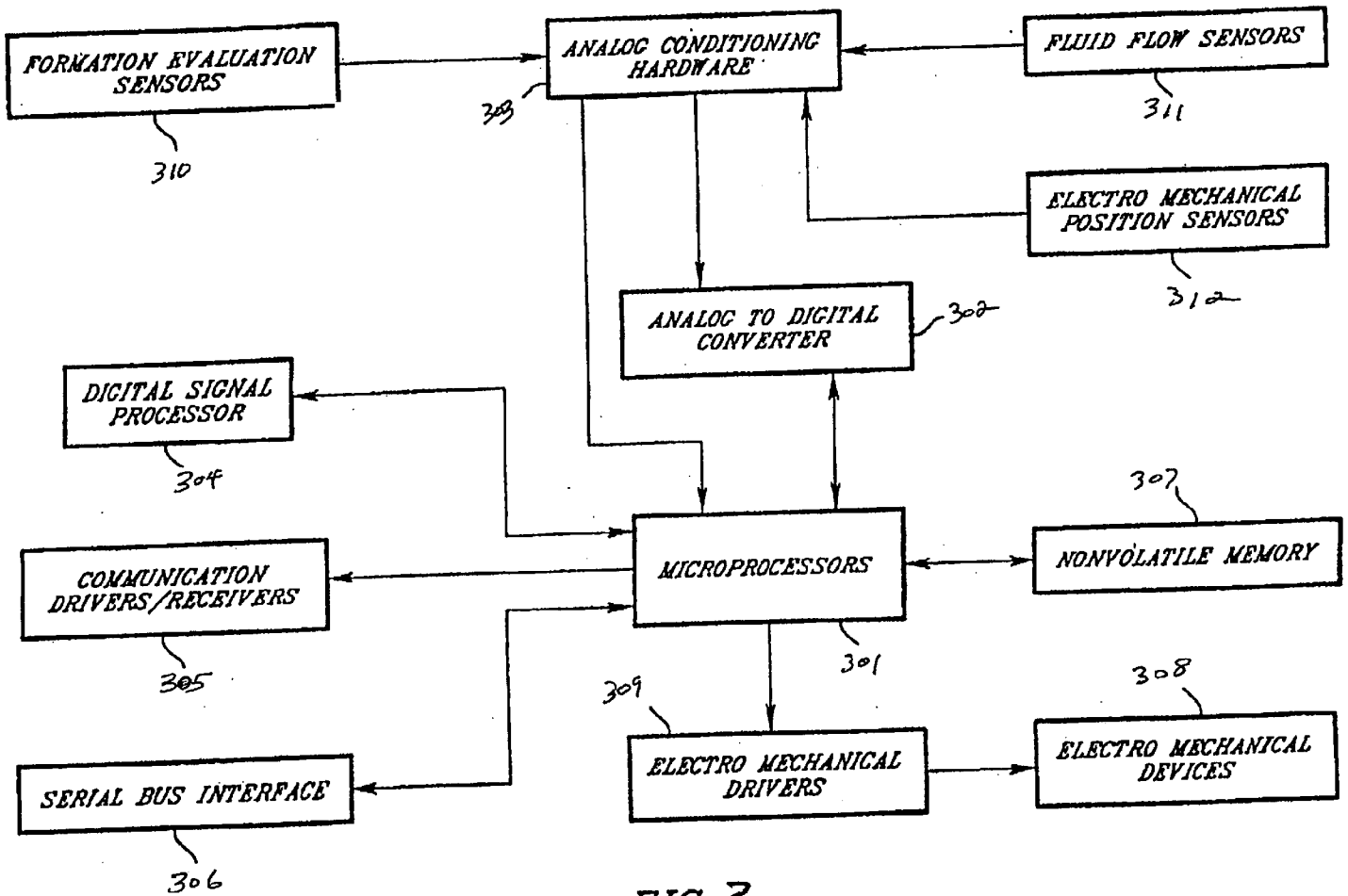
FIG. 3 is a block diagram illustrating a surface control and data acquisition system.

The surface control and data acquisition system controls the electromechanical systems, monitors formation and flow parameters, processes data acquired in the borehole, and transmits and receives commands and data to and from the remote controller 230. FIG. 3 is a block diagram illustrating the surface control and data acquisition system in more detail. The surface control and data acquisition system comprises one or more microprocessors 301, an analog to digital converter 302, analog conditioning hardware 303, digital signal processor 304, communications interface 305, serial bus interface 306, non-volatile solid state memory 307 and electromechanical drivers 308.

The microprocessor 301 provides the control and processing capabilities of the surface control and data acquisition system. The processor controls the data acquisition, the data processing, and the evaluation of the data for determination if it is within the proper operating ranges. The controller also prepares the data for transmission to the remote controller, and drive the transmitter to send the information to the remote controller 230 of FIG. 2. The processor 301 also has the responsibility of controlling the electromechanical devices 309. The analog to digital converter 302 transforms the data from the conditioner circuitry 303 into a binary number. That binary number relates to an electrical current or voltage value used to designate a physical parameter acquired from the geological formation sensors 310, the fluid flow sensors 311, or status of the electromechanical devices position sensors 312. The analog conditioning hardware 303 processes the signals from the sensors into voltage values that are at the range required by the analog to digital converter 302. The digital signal processor 304 provides the capability of exchanging data with the processor 301 to support the evaluation of the acquired downhole information, as well as to encode/decode data for transmitter. The processor 301 also provides the control and timing for the electromechanical drivers 308.

The communication drivers 305 are electronic switches used to drive the electrical signals over a transmission medium. The processor 301 provides the control and timing for the drivers 305. The serial bus interface 306 allows the processor to interact with other surface data acquisition and control systems and/or the internet server computer. The electromechanical drivers control the flow of electrical power to the electromechanical devices used for operation of the sliding sleeves, packers, safety valves, plugs, smart screens and any other fluid control device downhole. The drivers 309 are operated by the microprocessor 301. The non-volatile memory 307 stores the code commands used by the controller 301 to perform its functions downhole. The memory 307 also stores the variables used by the processor 301 to determine if the acquired parameters are in the proper operating range. It will be appreciated that downhole valves are used for opening and closing of devices used in the control of fluid flow in the wellbore. Such electromechanical downhole devices 309 can be actuated by the surface control and data acquisition system either in the event that a borehole sensor value is determined to be outside a safe to operate range set by the operator or if a command is sent from the surface.

The remote controller of FIG. 2 preferably comprises a satellite transceiver, a computer server, a personal computer and an internet browser access. The remote controller is linked by the satellite transceiver to a satellite system that transmits signals between the surface control and data acquisition system and the remote controller. The signals transmitted between the surface control and data acquisition system and the remote controller includes information or data collected by the data acquisition system, control signals for changing the operating parameters of particular wells/zones, and instructions for changing the operating optimization program. The server computer preferably comprises an internet web site server and provides a central processor and data storage for all of the data and other signals transmitted between the remote controller and the surface control and data acquisition system and the world wide web or internet. The server computer is linked to an internet system or other access systems that allows an user to access the server computer from any computer linked to the access system. The server is preferably also linked to the world wide web or internet system to provide user access from any computer that has an internet access. Access is limited to authorized users having correct passwords or other types of controlled access codes or methods. Thus, a user is not limited by the location of the remote controller because internet access is prevalently available throughout the world. Furthermore, portable computers can access the internet through wireless communications, such as analog or digital mobile phones or communication systems, and allow user access from any location accessible by the mobile phones.

Information sent from the remote controller 230 of FIG. 2 may consist of actual control information, or may consist of data which is used to reprogram the memory in the processor 301 of the surface control and data acquisition system for initiating of automatic control based on sensor information. In addition to reprogramming information, the information sent from the remote controller may also be used to recalibrate a particular sensor downhole through the surface control and data acquisition system. A plurality of downhole flow sensors and downhole formation evaluation sensors communicate with the surface control and data acquisition system. The sensors are permanently located downhole and are positioned in the completion string and/or in the borehole casing. The formation evaluation sensors, including density, porosity and resistivity types, are well known in the art and are commercially available. These sensors measure formation geology, formation saturation, formation porosity, gas influx, water content, petroleum content and formation chemical elements such as potassium, uranium and thorium. The formation evaluation sensors preferably provide formation evaluation data constantly such that the data is available in real or near real time, and there will be no need to periodically shut in the well and perform costly wireline evaluations.

The production well control system of this invention may utilize a wide variety of conventional as well as novel downhole tools, sensors, valving and the like. For example, the subsurface zones of each well are preferably isolated from one another, and each of the wellbores or well sections in communication with the respective subsurface zones is preferably provided with a valve control isolation system. The valve control isolation system is preferably controlled by the surface control system. Each zonal isolation control assembly is connected to a source of electric power such as production tubing carried cable and the surface control system, such as a control computer. The zonal isolation control assembly may be located within the primary wellbore section or located within branch bore sections as desired. Hydraulic fluid tubes for controlling electromechanical devices may also be disposed in parallel to the electrical lines or cables.

Figure 4:
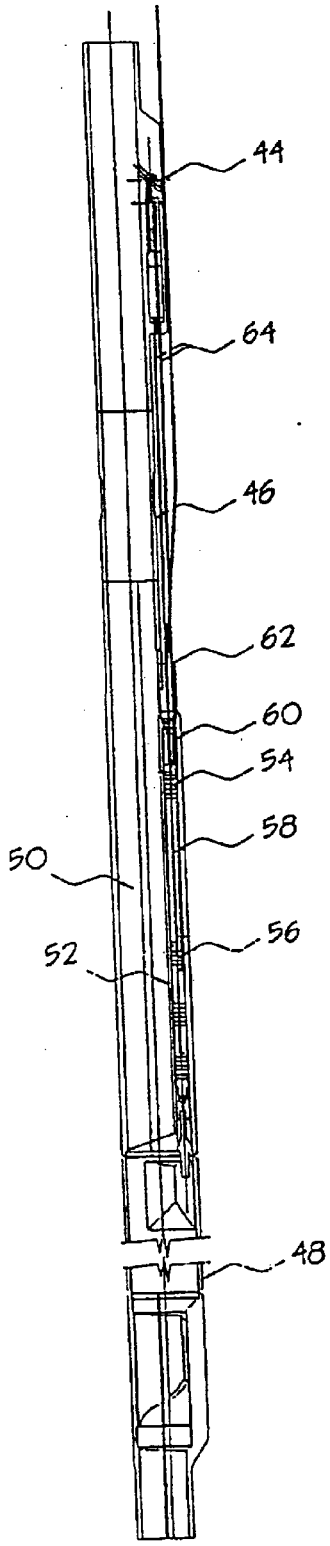
FIG. 4 is a schematic illustration of a zonal isolation control system.

FIG. 4 is a schematic illustration of one embodiment of a typical zonal isolation control system. Each of the zonal isolation control systems includes a valve module 44 which is designed for hydraulic opening and closing actuation. The valve module 44 is preferably in the form of a rotary ball or a sliding sleeve valve mechanism. Other suitable types of valves, such as electrically energized or hydraulically actuated valves or gate valves, may be employed as isolation valves without departing form the spirit and scope of this invention. The ball valve member 44 is coupled by a pup joint 46 to a controller instrument located in a permanently installed mandrel 48. The mandrel 48 is a component of the production tubing string of the well and has an internal flow passage 50 through which fluid is permitted to flow from the selected subsurface zone. Within the mandrel 48 is a side pocket 52 having an internal polished surface section for sealing engagement by seals 54 and 56 of an elongate tool 58 in the form of a differential pressure sensor electronic module or package having pressure sensors and perhaps other sensors, such as temperature sensors as desired, for sensing various properties of the production fluid entering the branch bores or primary wellbore from selected subsurface zones. The tool also includes a linear motion device to develop hydraulic fluid pressure which provides pressure induced opening or closing force for the valve element 42 of the valve sub. The tool 58 is also provided with an electrical connector 60 which is received by a wet-connect type electrical connector 62 in mandrel 48 to establish electrical connection with the position sensing system of the ball valve mechanisms 44. The tool 58 also establishes fluid connection with hydraulic opening and closing lines or passages 64 that are operatively coupled with ball valve sub 42 for hydraulically energized operation (opening or dosing) of the valve element 44.

Figure 5:
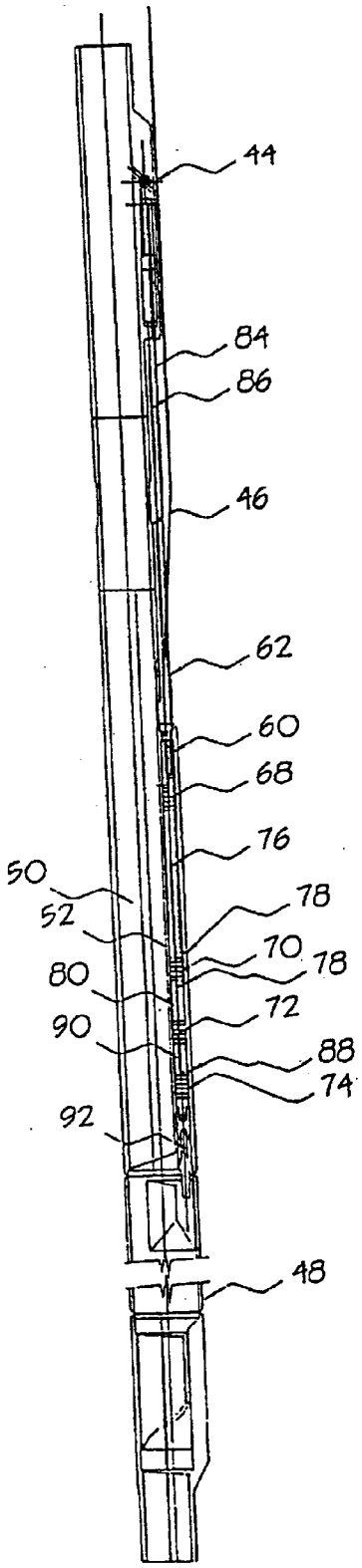
FIG. 5 is a schematic illustration of the zonal isolation control tool, having a linearly moveable sleeve type zone control valve and showing its wet-connector, polished surface to permit sealing of the tool internally of the side pocket of the mandrel, seals for sealing within the mandrel and a latch mechanism for latching the tool within the side pocket of the mandrel.

Referring now to FIG. 5, the zonal isolation control tool shown generally at 58 is of an elongate configuration and is adapted to be received within the side pocket 52 of the mandrel as shown in FIG. 4. The tool 58 incorporates external packings 68, 70, 72 and 74 which engage respective internal polished sealing surfaces of the side pocket, with the wet-connect type electrical connector 60 projecting above the upper packing 68 and adapted for electrical connection with the circuit connector 62 shown in FIG. 4. An electronic package within section 76 of the tool between the packings 68 and 70. Well fluid pressure that is present within the casing/tubing annulus between the packings is communicated within the tool for pressure sensing by the electronic package via a casing pressure sensing port 78. From the standpoint of opening and closing movement of the isolation valve, whether it is in the form of a ball valve, sleeve valve, gate valve, or the like, the tool section 80 between the packings 70 and 72 defines a "valve open" port 82 that is communicated by a hydraulic control line 84 with the isolation valve in a manner wherein hydraulic pressure in the line or passage 84 will cause opening movement of the isolation valve. Closing movement of the isolation valve is accomplished by a "valve close" hydraulic fluid line or passage 86 which is communicated via a valve close port 88 that is located within tool section 90 between the packing elements 72 and 74. For securing the tool 58 within the side pocket 52 of the mandrel 48 in the manner shown in FIG. 2, the lower portion of the tool is defined by a latch mechanism 92 that is adapted for latching engagement with an internal latch profile that is defined within the lower portion of the side pocket of the mandrel.

Figure 6:
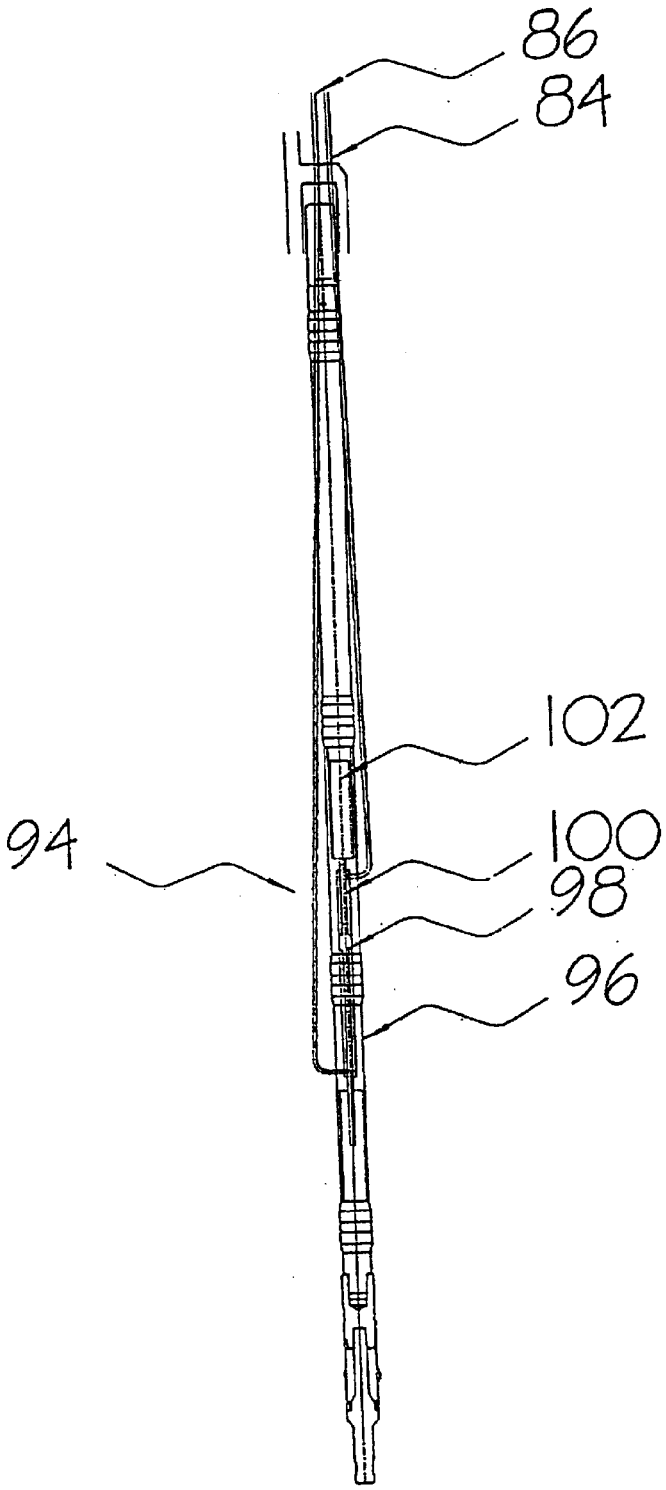
FIG. 6 is a schematic illustration in section, showing moveable plunger, moveable by linear or rotary actuation, and having hydraulic "open" and "close" passages through which hydraulic fluid is conducted for valve actuation.
Figure 7:
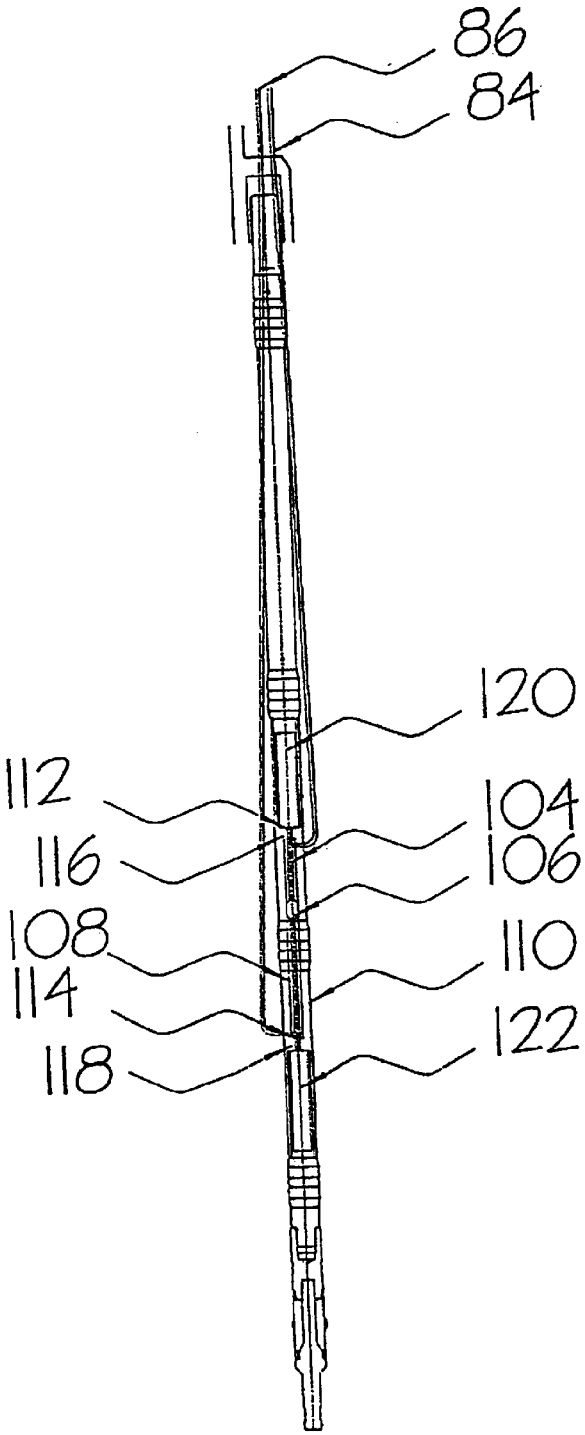
FIG. 7 is a schematic illustration in section showing a plunger actuated piston and housing assembly and having one or more actuators for "opening" and "closing" movement of the plunger and piston.

Referring now to FIG. 6, for the purpose of imparting opening or closing movement to the isolation valve mechanism, a hydraulic actuator is shown generally at 94 and comprises a hydraulic cylinder 96 having a piston 98 moveably deposed therein. The piston is linearly moveable within the cylinder by an elongate plunger element 100. The plunger is moveable by a plunger actuator 102 that is electrically operated. The plunger actuator may be of the linear type, such as may be defined by a solenoid mechanism or it may conveniently take the form of a rotary type, such as being in the form of a rotary electric motor driving a threaded element having threaded engagement with the plunger 100. In this case, rotation of the threaded drive element will impart linear movement to the plunger member and will develop significant hydraulic pressure of achieving opening and closing movement of the zonal isolation valve. Other types of electrically energized actuators may be also utilized for moving the plunger linearly to thus move the piston 98 linearly within the cylinder 96. When the plunger is moved upwardly, hydraulic pressure is increased in the hydraulic line 84 causing forcible opening of the isolation valve. In the alternative, when the plunger moves the piston downwardly hydraulic pressure is increased in the flow line or passage 86 thereby forcibly closing the isolation valve. As shown in FIG. 7, an alternative embodiment of the zonal isolation control system may incorporate a linearly moveable plunger 104 that moves a piston member 106 linearly within the piston chamber 108 of a plunger housing or cylinder 110. Opposite ends 112 and 114 of the plunger may extend through passages defined in respective end walls 116 and 118 of the cylinder, thus permitting the plunger to be actuated by an electrically energized power mechanism located externally of the cylinder. If desired, power actuator 120 may impart opening and closing movement to the plunger. In the alternative, one power actuator may impart opening movement to the plunger while another plunger actuator 122 may impart closing movement to the plunger.

Figure 8:
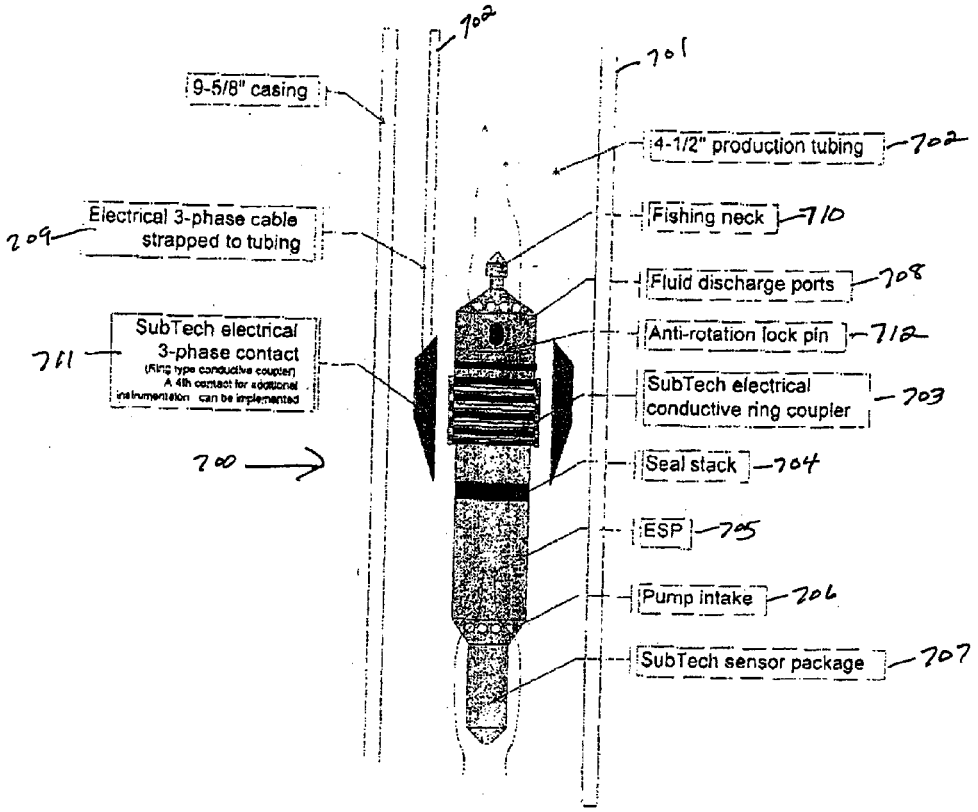
FIG. 8 is a schematic illustration, partially in section, showing a retrievable pump/seal tool disposed in a well bore.

The side pocket mandrel/kickover system, as shown in FIGS. 4, 5 and 6, illustrates one way of retrieving downhole components without the use of a complete draw works or rig to pull production tubing. The electrical submersible pump and seal packer tool illustrated in FIG. 8 shows another way to accomplish this feat in the system of the present invention. In FIG. 8, a seal/pump tool 700 is run into the system via wireline interior to production tubing 702 which is placed inside casing 701. The seal/pump tool 700 comprises an elongate body which houses an inductive ring coupler 703, a seal stack or packer 704 and an ESP (Electrical Submersible Pump) 705. Pump intake ports 706 are located below coupler 703 and above a sensor package 707. Pump discharge ports 708 are located inside tubing 702 which carries a three-phase electrical cable 709 supplying power and communications to pump 705 and sensor 707 which provide data to the surface control and data acquisition system as previously described. The upper end of tool 700 is provided with a fishing neck 710 for wireline retrieval or with a coil tubing detachable connector (not shown) if desired. Tool 700 may be lowered inside production tubing 702 on wireline or by coil tubing in the case of placement in a horizontal borehole. The tool 700 may also be deployed by electrical wire line (or e-line) and hydraulic pumping. The end of production tubing 702 is provided with a locking nipple having an inductive coupling 711. An anti-rotation lock pin 712 prevents rotation of tool 700 when landed onto locking nipple/inductive coupler 711. The locking nipple 711 also prevents vertical movement of tool 700 due to pressure differences above/below seal packer 704. Operation of the tool 700 can be controlled through control lines connected to the tool 700 through wet connectors or inductive couplers. The control lines can include fiber optic lines, electric lines, fluid lines, and wireless components, such as electromagnetic devices, earth conduction devices, and acoustic devices. Once landed, tool 700 is activated by command signals from surface control and data acquisition system 220 of FIG. 2, and the packer 704 isolates the input and output fluid ports 706,708. Operation of the tool 700 is given with more detail in Norwegian Patent Application 19992948, filed on Jun. 16, 1999. If it is desired to retrieve tool 700, a wireline fishing tool, or the like, is lowered and engages the fishing neck 710. Coil tubing retrieval may be performed similarly. In either instance it is not necessary to provide a draw works or rig to pull production tubing 702.

The production well control system of this invention may utilize a wide variety of downhole tools, sensors, and valves, including: a retrievable sensor gauge, side pocket mandrel; subsurface safety valve position and pressure monitoring system; remotely controlled inflation/deflation device with pressure monitoring; remotely actuated downhole tool stop system; remotely controlled fluid/gas control system; and remotely controlled variable choke and shut-off valve system. Examples of these downhole tools are described in U.S. Pat. No. 5,732,776, Tubel et al., hereby incorporated by reference in its entirety. These tools are electrically connected to the downhole control module or to the surface control system and linked in satellite communication with the remote control system as described above.

Figure 9:
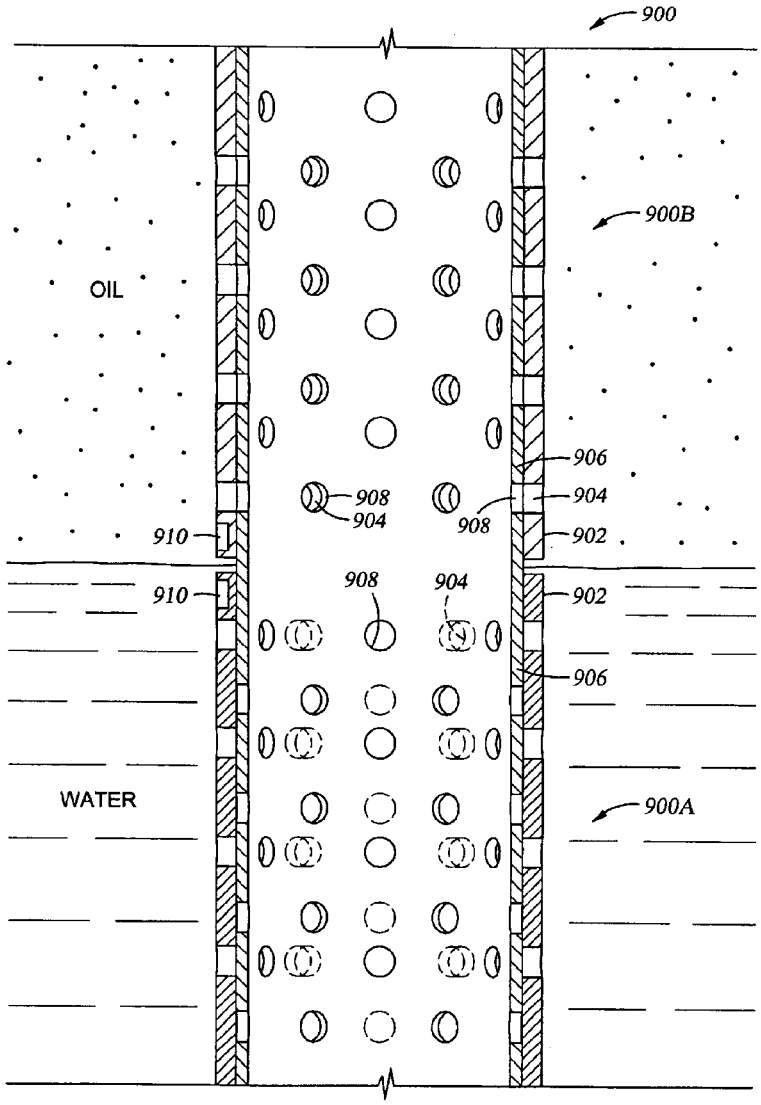
FIG. 9 illustrates a downhole smart screen system 900 for selectively controlling fluid flow through the production tubing.

Additionally, the downhole tools may include one or more downhole smart screen systems disposed on a production tubing. FIG. 9 illustrates a downhole smart screen system 900 for selectively controlling fluid flow through the production tubing. The smart screen system 900 includes a rotatable tubing portion 902 having a plurality of inlet ports 904 and a fixed tubing portion 906 having a corresponding number of inlet ports 908. Although the rotatable tubing portion 902 is shown as the outer tubing, it is under stood that the rotatable tubing portion can be positioned alternately as the inner tubing. The inlet ports 904, 908 may be disposed circumferentially around the tubing or only a portion of the circumference. The inlet ports 904, 908 preferably comprise a plurality of circular holes spaced apart such that the portion of tubing between adjacent holes is wider than the diameter of the holes. Alternatively, the inlet ports comprise openings such as longitudinal slits, ovals, and other shapes. The rotatable tubing portion 902 is controlled by a control line (not shown) and rotatable between a closed position (as shown by 900A) and an open position (as shown by 900B). A variety of driver devices can be used to control the movement of the rotatable tubing portion 902, including hydraulic and electric devices. In a closed position, the rotatable tubing portion 902 is rotated such that the each inlet port 904 is blocked by the portion between adjacent inlets ports 908. In an open position, the inlet ports 904 and 908 are aligned in matching positions to allow fluid intake into the tubing. The smart screen system 900 preferably includes a plurality of fluid sensors 910 disposed on the production tubing for sensing the fluid around the production tubing. For a hydrocarbon production, when the fluid sensor 910 detects hydrocarbon fluids (e.g., oil) around the production tubing, the fluid sensor 910 sends a signal to a controller connected to the smart screen system to rotate the rotatable tubing portion to an open position to allow flow into the production tubing. When the fluid sensor 910 detects water or other undesired formations around the tubing, the fluid sensor 910 sends a signal to a controller connected to the smart screen system to rotate the rotatable tubing portion to a closed position. The smart screen system promotes efficient hydrocarbon production and reduces undesirable contents into the production system.

The present invention also provides control modules placed inside the wellbore (i.e., well bore devices) to control the flow of fluids in the wellbore to optimize the pump efficiency. The wellbore devices, such as electrical submersible pumps, are preferably remotely controlled from the surface using a hydraulic or electric lines deployed from the surface into the wellbore along the casing or production tubing. Operation of the well bore devices can also be controlled by other control lines such as fiber optic lines or wireless components. The downhole devices can also be connected to the control and data acquisition system utilizing one or more communication members selected from electrical cables, fiber optic cables, hydraulic devices, electromagnetic devices, earth conduction devices, and acoustic devices. The control lines are preferably connected to the well bore devices through wet connects or inductive couplers. The flow of fluids from these devices in the wellbore can be controlled from a remote location by sending a command to the downhole system, for example via satellite communications to increase or decrease the flow through the tool. The communications in the wellbore can be done using electrical cables and digital or analog communications techniques. The remote control system according to the invention can also provide control of the amount of chemicals delivered inside the wellbore using the same technique to eliminate paraffin, and scale buildup in the wellbore, such as calcium carbonate. Another aspect of the invention monitors and controls steam injection into the wellbore, formation influx and water influx using the remote controller. Other applications of the remote controller and/or the closed loop control system described above according to the invention are contemplated by the inventors.

While the foregoing is directed to the preferred embodiment of the present invention, other and further embodiments of the invention may be devised without departing from the basic scope thereof. The scope of the invention is determined by the claims which follow.

What is claimed is:

1. An apparatus for downhole production or injection wells, comprising:

a) one or more downhole production or injection wells; and b) a control system comprising:

i) one or more surface control and data acquisition systems;

ii) one or more sensors disposed in communication with the surface control and data acquisition systems;

iii) one or more downhole devices disposed in communication with the surface control and data acquisition systems; and iv) one or more remote controllers disposed in communication through a server with the surface control and data acquisition systems, wherein the one or more remote controllers may reprogram a processor of the one or more surface control and data acquisition systems.

2. The apparatus of claim 1 wherein the downhole devices comprise one or more devices selected from the group of smart shunt screens, sliding sleeves, chemical injection devices, circulating valves, gas lift valves, water injection valves, smart screens chokes, diverters, flappers, safety valves, and packers.

3. The apparatus of claim 1 wherein the downhole devices are disposed in communication with one or more components of the one or more downhole production or injection wells.

4. The apparatus of claim 1 wherein the downhole devices are disposed in communication with one or more sensors of the control system.

5. The apparatus of claim 1 wherein the one or more sensors comprise one or more permanent downhole sensors.

6. The apparatus of claim 1 wherein the one or more sensors comprise one or more retrievable sensors.

7. The apparatus of claim 1 wherein the control system comprises an electric control system.

8. The apparatus of claim 1 wherein the downhole production well comprises an artificial lift system disposed in cooperation with the downhole well.

9. The apparatus of claim 8 wherein the artificial lift system includes a programmable automation control system.

10. The apparatus of claim 8 wherein the artificial lift system includes one or more surface sensors disposed to monitor operation of the artificial lift system.

11. The apparatus of claim 8 wherein the artificial lift system includes one or more sub-surface sensors disposed to monitor operation of the artificial lift system.

12. The apparatus of claim 8 wherein the control system comprises an electric control system.

13. The apparatus of claim 1, further comprising:

a retrievable pump system disposed in cooperation with the downhole production or injection well.

14. The apparatus of claim 13 wherein the retrievable pump system comprises sensors.

15. The apparatus of claim 13 wherein the retrievable pump system is deployed by a component selected from the group consisting of coil tubing, electric line, hydraulic pumping, and wire line.

16. The apparatus of claim 15 wherein the retrievable pump system is connected to one or more communication control member selected from the group of fiber optic lines, fluid pumping lines, electric lines and wireless components.

17. The apparatus of claim 13 wherein the retrievable pump system comprises one or more pumps selected from the group consisting of an electric submersible pump, a linear motor drive pump, an impeller driven pump, a progressive cavity pump, a gas lift, a rod pump and a jet pump.

18. The apparatus of claim 17 wherein the electric submersible pump is disposed in electrical connection with one or more wet connects disposed inside a production tubing of the downhole production well.

19. The apparatus of claim 17 wherein the electric submersible pump is disposed in electrical connection with an inductive coupler connected to the control system.

20. The apparatus of claim 1 wherein the control system further comprises:

a communication device disposed between the server and the one or more surface control and data acquisition systems.

21. The apparatus of claim 20 wherein the communication device comprises one or more devices selected from the group of a telephone system, a satellite system, an internet system, and a radio system.

22. The apparatus of claim 1 wherein the remote controller comprises a computer having an internet access.

23. The apparatus of claim 22 wherein the control system further comprises:

a satellite system adapted to link signals between the server and the surface control and data acquisition system.

24. An apparatus for downhole production or injection, comprising:

a) one or more completed electrically controlled wells;

b) one or more artificial lift systems incorporated in the one or more completed wells; and c) a control system comprising:

i) one or more surface control and data acquisition systems;

ii) one or more formation sensors disposed in communication with the surface control and data acquisition systems;

iii) one or more devices of the artificial lift system disposed in communication with the surface control and data acquisition systems; and iv) one or more remote controllers disposed in communication through a server with the surface control and data acquisition system, wherein the one or more remote controllers may reprogram a processor of the one or more surface control and data acquisition systems.

25. The apparatus of claim 24 wherein the one or more artificial lift systems comprises one or more surface sensors and one or more sub-surface sensors.

26. The apparatus of claim 24 wherein the one or more artificial lift systems comprise one or more programmable automation control systems.

27. The apparatus of claim 24, further comprising:

a retrievable pump system disposed in cooperation with the electrically controlled well.

28. The apparatus of claim 27 wherein the retrievable pump system is deployed by a component selected from the group consisting of coil tubing, electric wire line, hydraulic pumping, and wire line.

29. The apparatus of claim 28 wherein the retrievable pump system is connected to one or more control lines selected from the group consisting of fiber optic lines, fluid pumping lines, and electric lines.

30. The apparatus of claim 27 wherein the retrievable pump system comprises one or more pumps selected from the group consisting of an electric submersible pump, a linear motor drive pump, an impeller driven pump, a progressive cavity pump, a gas lift, a rod pump and a jet pump.

31. The apparatus of claim 30 wherein the retrievable pump system is disposed in electrical connection with one or more wet connects disposed inside a production tubing of the downhole production well.

32. The apparatus of claim 24, further comprising:

a communication device disposed between the server and the one or more surface control and data acquisition systems, wherein the communication device comprises one or more devices selected from the group of a telephone system, a satellite system, an internet system, and a radio system.

33. The apparatus of claim 24 wherein the remote controller comprises a computer having an internet access.

34. The apparatus of claim 33 further comprising:

a satellite system adapted to link signals between the server and the one or more surface control and data acquisition systems.

35. The apparatus of claim 2, wherein the smart shunt screen comprises:

a rotatable tubular member having a plurality of inlet ports; and a fixed tubular member having a corresponding number of inlet ports as the rotatable tubular portion.

36. The apparatus of claim 35, wherein the rotatable tubular member and the fixed tubular member are coaxially disposed relative to each other.

37. The apparatus of claim 36, wherein inlet ports of the rotatable tubular member and the fixed tubular member are aligned when the smart shunt screen is in an open position.

* * * * *